US005357666A

United States Patent [19]

El Dessouky et al.

[11] Patent Number: 5,357,666

[45] Date of Patent: Oct. 25, 1994

[54] FASTENER INSTALLATION TOOL HEAD QUICK DISCONNECT ASSEMBLY

[75] Inventors: Ahmed A. El Dessouky, Pico Rivera; Michael A. Kleyman, Sherman Oaks, both of Calif.

[73] Assignee: Textron Inc., Providence, R.I.

[21] Appl. No.: 154,591

[22] Filed: Nov. 18, 1993

[51] Int. Cl.[5] ..... B21J 15/10

[52] U.S. Cl. ..... 29/243.521; 29/243.523

[58] Field of Search ..... 29/243.521, 243.523, 29/243.524, 243.525; 72/391.2, 391.4

[56] References Cited

U.S. PATENT DOCUMENTS

| | | | |
|---|---|---|---|
| 3,406,557 | 10/1968 | Harris | 29/243.521 |
| 3,616,673 | 11/1971 | Miklos | 29/243.523 |
| 4,118,969 | 10/1978 | Corbett | 29/243.525 |
| 4,770,023 | 9/1988 | Schwab | 29/243.523 |

FOREIGN PATENT DOCUMENTS

| | | | |
|---|---|---|---|
| 1235855 | 6/1971 | United Kingdom | 29/243.523 |

*Primary Examiner*—David Jones

*Attorney, Agent, or Firm*—Knobbe, Martens, Olson & Bear

[57] ABSTRACT

An apparatus and method for quickly and easily disengaging and re-engaging a fastener installation tool head from a fastener installation tool body. A novel fastener installation tool head quick disconnect assembly is provided, consisting in a preferred arrangement of a sleeve assembly and an adapter housing assembly. The adapter housing assembly is rigidly attached to the fastener installation tool body and the sleeve assembly is attached to the adapter housing assembly via a quick-disconnect latching mechanism on the adapter housing assembly. To remove the sleeve assembly from the adapter housing assembly the operator simply translates the latching mechanism rearwardly, rotates the sleeve assembly 60° to align an internal and an external set of lugs and grooves on the assemblies, and pulls the sleeve assembly forward disengage the sleeve assembly from the adapter housing assembly. To re-engage, the operator simply aligns the two components with one another, translates the sleeve assembly rearwardly into the adapter housing assembly, and rotates the sleeve assembly 60°, thereby quickly and easily locking the sleeve assembly into the adapter housing assembly.

24 Claims, 7 Drawing Sheets

FASTENER INSTALLATION TOOL HEAD QUICK DISCONNECT ASSEMBLY

BACKGROUND OF THE INVENTION

1. Field of the Invention

The present invention relates to a tool for installing rivets on and a method for connecting tool components, and more particularly, to a quick disconnect assembly for a tool head.

2. Description of the Related Art

Many manufacturing processes employ fasteners or rivets to permanently join one workpiece to another. One common rivet includes a rivet sleeve or body, and a rivet stem which extends through the sleeve with an enlarged head at the end opposite a rivet head on the sleeve.

Typically, to fasten two or more workpieces together, the rivet is placed through a hole in the workpieces such that the underside of the rivet head is flush against the workpiece while the tail of the sleeve and the head on the stem extend beyond the workpiece. While holding the rivet sleeve in place, the rivet stem is pulled axially further into a central bore in the sleeve such that the rivet stem head deforms and expands the tail of the rivet body on the backside of the workpieces. As the tension in the stem increases, the stem eventually breaks at a predefined location such that the stem head and the stem shank remain with the sleeve while the remainder of the stem shank is pulled free and discarded. The rivet is then permanently locked in place by the rivet head on the frontside surface of the workpieces and the expanded rivet body on their backside surface, thereby permanently fastening the workpieces together.

To perform the rivet setting operation described above, specially designed rivet setting tools have been developed that employ pneumatic or hydraulic pressure to actuate the device and set the rivet. While complex mechanically, these pneumatic and hydraulic tools are often preferred because they are stronger, faster, and more consistent than their human-powered counterparts.

One drawback of these devices, however, is that during operation a rivet can get jammed in the head of the rivet setting tool. When this occurs, the rivet setting tool is disabled and cannot operate further until the offending rivet is extracted from the tool head and the rivet setting tool is reset. Because traditional tool heads are attached to the rivet setting tool via screw threads, removal of the tool head requires the operator to use a wrench to loosen the tool head and then unscrew the tool head from the rivet setting tool. Further, a collet within the tool head must be separated from a drawbar, that reciprocates in the tool, before access can be had to the fastener gripping jaws and the obstructing fastener. Attaching a new tool head to the rivet setting tool is accomplished by the reverse operation but properly positioning and holding the jaws and other internal components while attaching the collet to the drawbar, is difficult and time consuming.

While the tool head replacement is being performed, the rivet setting tool is non-operational. If the tool is in an automated production line, this tool shut down creates a bottleneck in the entire production line, resulting in lost time and money. Consequently, the users of pneumatic- and hydraulic-powered rivet setting tools have long been in need of an apparatus and method for quickly rectifying these rivet jams.

SUMMARY OF THE INVENTION

Accordingly, it is an object of the present invention to provide an apparatus and method for quickly and easily disconnecting a fastener installation tool head from a fastener installation tool body and replacing it with a functioning head, allowing a jammed head to be disassembled and unjammed away from the fastener installation site.

Another object of the present invention is to provide an apparatus and method for ensuring that when the fastener installation tool head is connected to the fastener tool installation body, the former is securely locked into its operational position and thereby prevented from either translational or rotational movement.

The present invention achieves these and other objects by providing a novel fastener installation tool head quick disconnect assembly. In a preferred arrangement, this tool head quick disconnect assembly consists of a sleeve assembly and an adapter housing assembly. The adapter housing assembly is rigidly attached to the fastener installation tool body via screw threads. The sleeve assembly is attached to the adapter housing assembly via a latching mechanism on the adapter housing assembly. When the tool operator desires to remove the sleeve assembly from the adapter housing assembly, the operator simply translates the latching mechanism rearwardly, rotates the sleeve assembly a small amount, and pulls the sleeve assembly forward, thereby quickly and easily disengaging the sleeve assembly from the adapter housing assembly. To re-engage the sleeve assembly with the adapter housing assembly, the operator simply reverses the procedure. Connecting the two assemblies includes connecting the rear of a sleeve to the front of an adaptor housing, and simultaneously connecting the rear of a collet in the sleeve to the forward end of a drawbar in the housing.

In a preferred arrangement, the sleeve assembly and the adapter housing assembly of the novel fastener tool head quick disconnect assembly employ two sets of engaging lugs, one of which cooperates with the latching mechanism, to ensure that when the sleeve assembly is connected to the adapter housing assembly, the sleeve mechanism is securely locked into its operational position and thereby prevented from either translational or rotational movement.

Moreover, in a preferred arrangement of the novel tool head quick disconnect assembly, the sleeve assembly contains both a groove/indent feature and opposing flush tapered surfaces for quickly and easily obtaining axial, lateral, and rotational alignment of its internal and external components and for ensuring that these components retain axial, lateral, and rotational alignment at all times during the operation of fastener installation tool. Similarly, the adapter housing assembly contains both a slot/set screw feature and opposing flush tapered surfaces for quickly and easily obtaining axial, lateral, and rotational alignment of its internal and external components and for ensuring that these components retain axial, lateral, and rotational alignment at all times during the operation of fastener installation tool.

The novel fastener tool head quick disconnect assembly greatly facilitates the removal and replacement of a rivet setting tool head. The significant changeover timesaving achieved by using the novel tool head quick disconnect assembly greatly reduces the down time of the fastener installation tool due to rivet jams. The production line is interrupted for far shorter time periods because of tool head changeovers, resulting in significantly increased line productivity and therefore substantial cost savings.

The Prior Art

Figure 1:
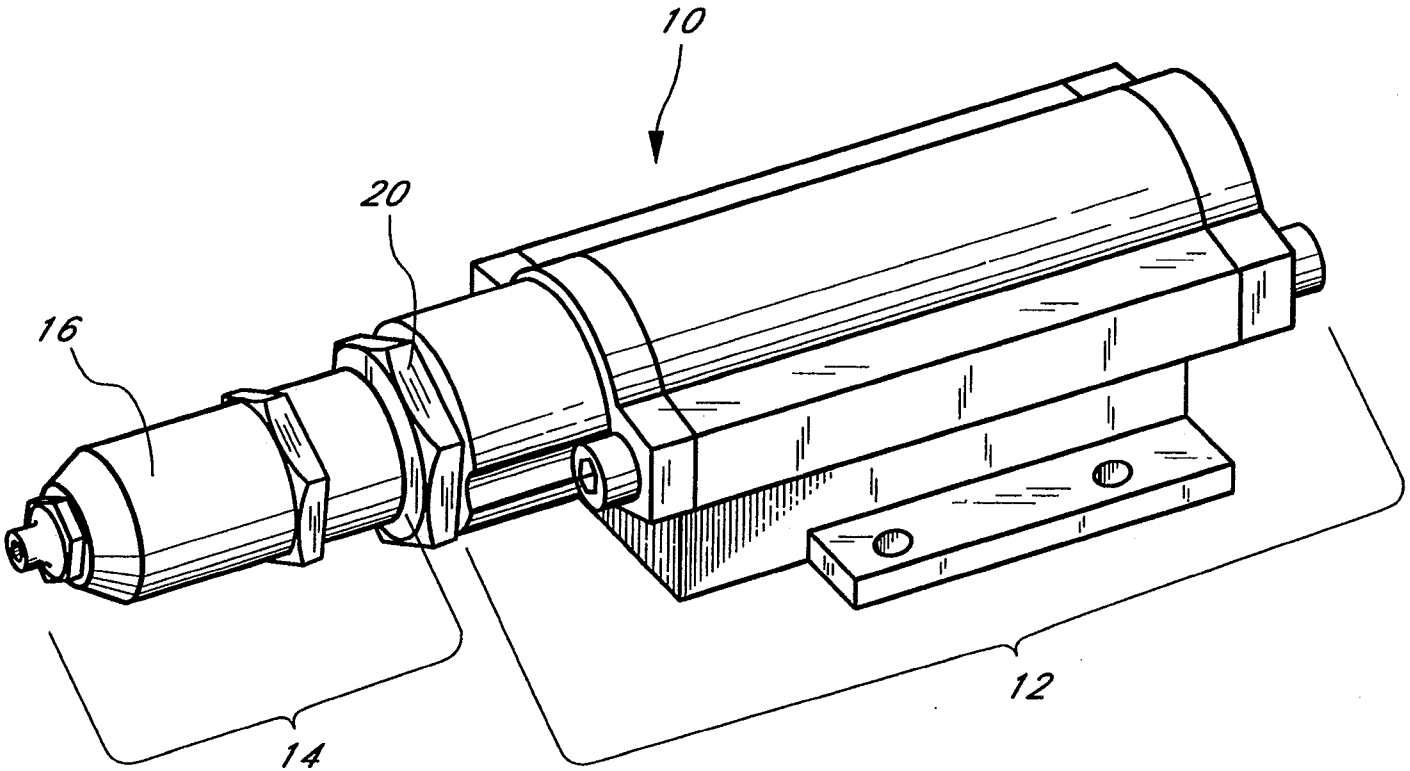
FIG. 1 (PRIOR ART)
FIG. 1 is a perspective view of a prior art apparatus.

Referring first to FIG. 1, a known fastener installation tool 10 is comprised of two primary components: a tool body 12 and a tool head assembly 14. The assembly 14 includes a sleeve 16 slidably supporting jaws and a collet (not shown) for gripping a fastener stem. The collet is threaded to a drawbar (not shown) which is slidably mounted in the tool body. The sleeve is attached to the tool body 12 via a tool head mounting nut 20 or threaded directly to the tool body 12.

As discussed, during the operation of the tool 10, a rivet (not illustrated) may become undesirably lodged within the jaws within the sleeve 16, thereby obstructing it. In this event, it is typically necessary for the tool operator to remove the sleeve 16 from the tool body in order to remedy the problem. To remove the sleeve 16 from the tool body, a wrench is used to loosen the nut 22, thereby permitting the sleeve 16 to be unscrewed and removed from the tool body 12. However, before the offending rivet can be extracted from the jaws within the collet, the collet must be unthreaded from the drawbar. To reinstall the sleeve 16, the reverse procedure is performed, but as noted above this is a difficult task requiring too much down time for a production line.

DETAILED DESCRIPTION OF THE PREFERRED EMBODIMENT

Figure 2:
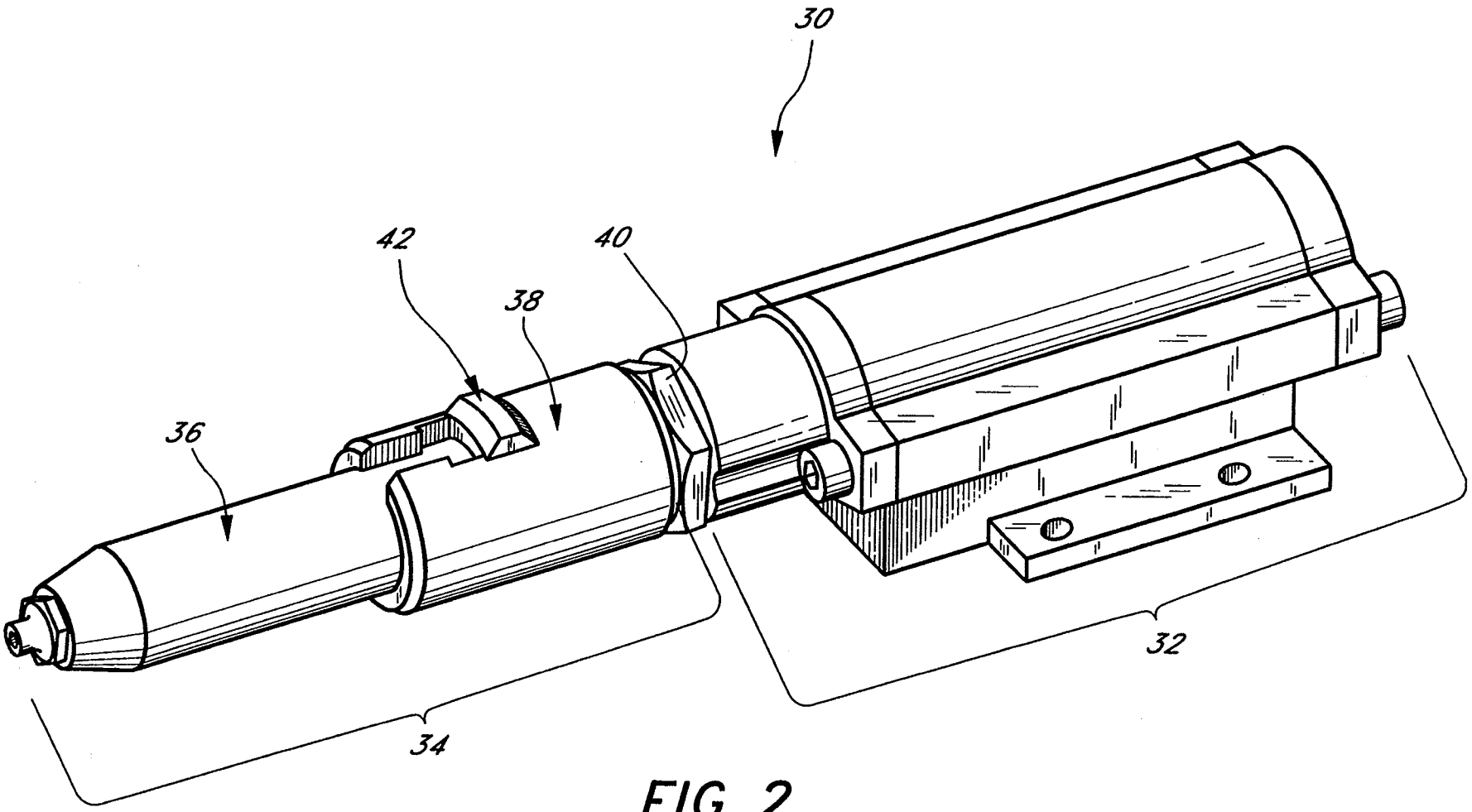
FIG. 2 is a perspective view of a preferred embodiment of the fastener installation tool head quick disconnect assembly in accordance with the present invention.

Referring now to FIG. 2, a novel fastener installation tool 30 in accordance with the present invention is illustrated. Analogous to the standard fastener installation tool 10, as illustrated in FIG. 1, the novel fastener installation tool 30 is comprised of two primary components: a tool body 32 and a tool head assembly 34. The body 32 of the novel tool 30 is essentially identical to the body 12 of the tool 10, of FIG. 1. The assembly 34 includes a sleeve assembly 36 which unlike the tool in FIG. 1, is attached to the adapter housing assembly 38 via a latching mechanism 42 on the adapter housing assembly 38.

Figure 3:
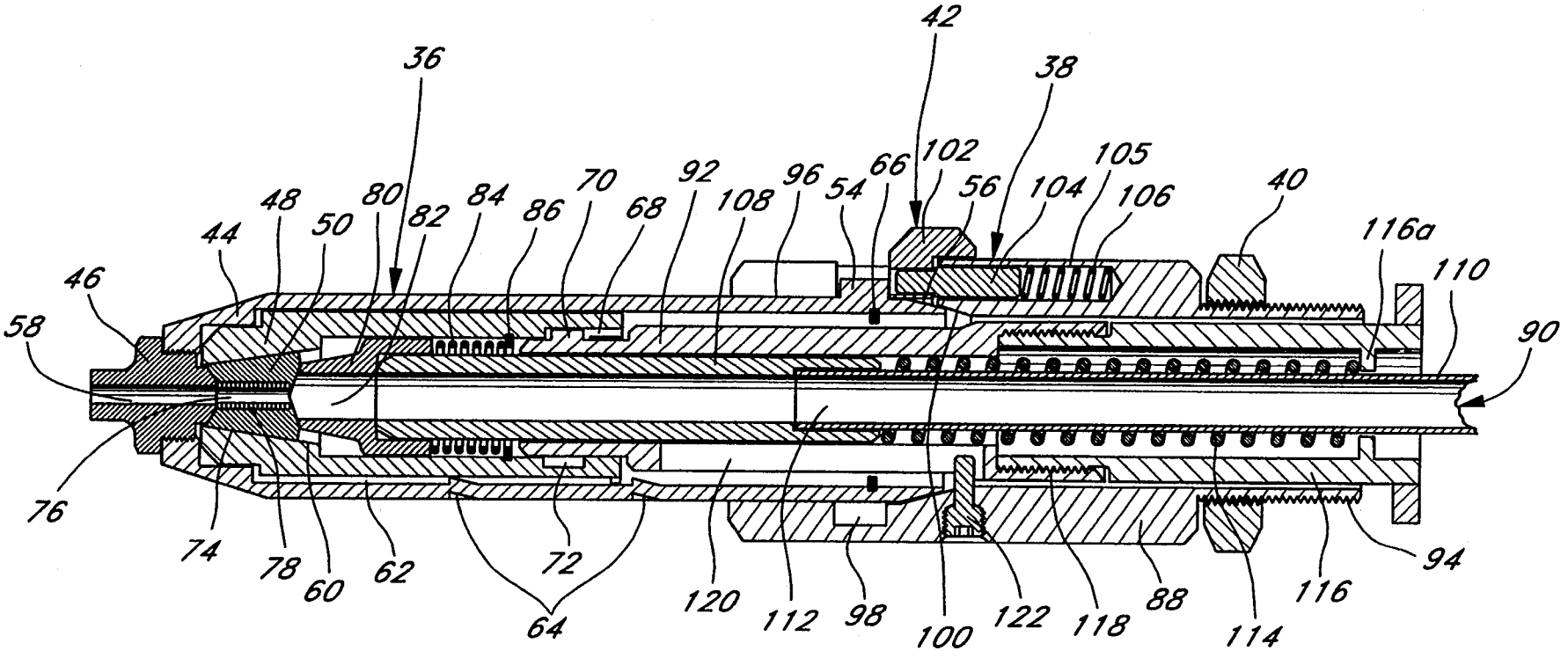
FIG. 3 is a side elevation cross-sectional view of the fastener installation tool head quick disconnect assembly depicted in FIG. 2.
Figure 4:
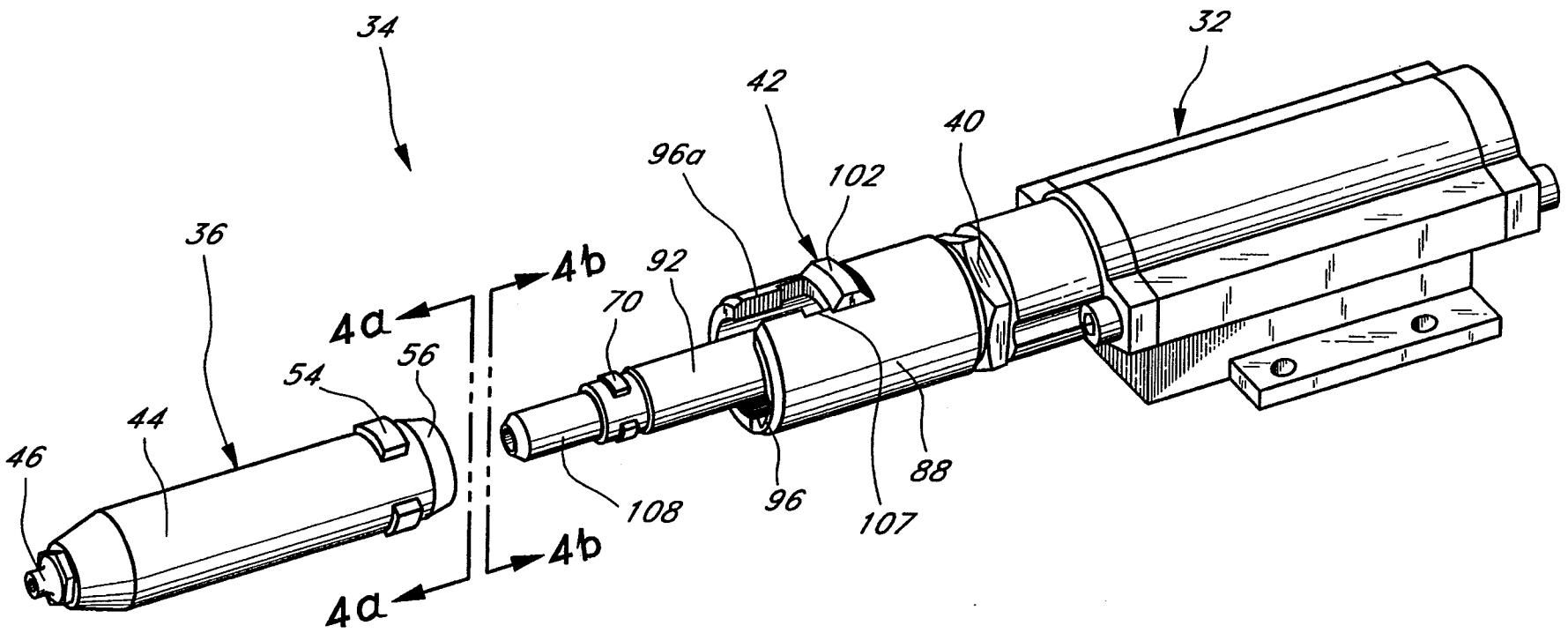
FIG. 4 is a perspective view of the fastener installation tool head quick disconnect assembly depicted in FIG. 2 with the sleeve assembly removed from the adapter housing assembly.
Figure 4B:
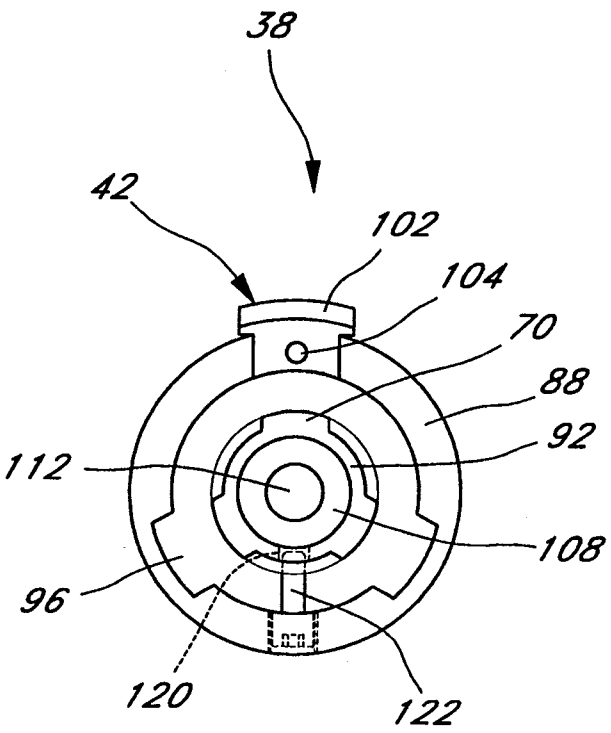
FIG. 4*b* is a front elevation view of the adapter housing assembly depicted in FIG. 4.
Figure 4A:
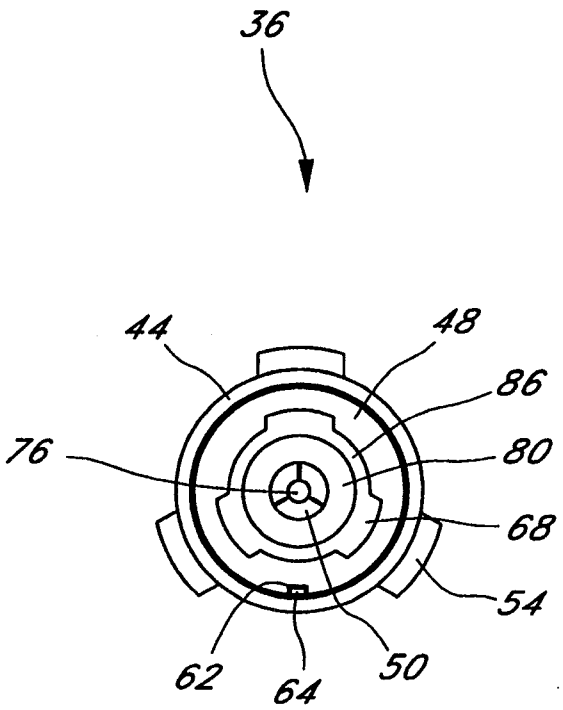
FIG. 4*a* is a rear elevation view of the sleeve assembly depicted in FIG. 4.

Referring to FIGS. 3–6, the sleeve assembly 36 include a sleeve 44, a nosepiece 46, a collet 48, and a set of jaws 50. The cylindrically shaped sleeve 44 has a forward end to which the nosepiece 46 is threaded. As best illustrated in FIGS. 4 and 4*a*, located on the exterior surface of the rearward end of the sleeve 44 are three sleeve lugs 54, equally spaced around the perimeter of the sleeve 44, i.e., 120° apart. The rearward exterior surface of the sleeve 44 is tapered inwardly to form a sleeve taper 56 such that the exterior diameter of the rear of the sleeve 44 is at its smallest at the extreme rearward end.

The tubular nosepiece 46 has a central bore 58 running through its axis to accept a rivet stem.

Figure 6:
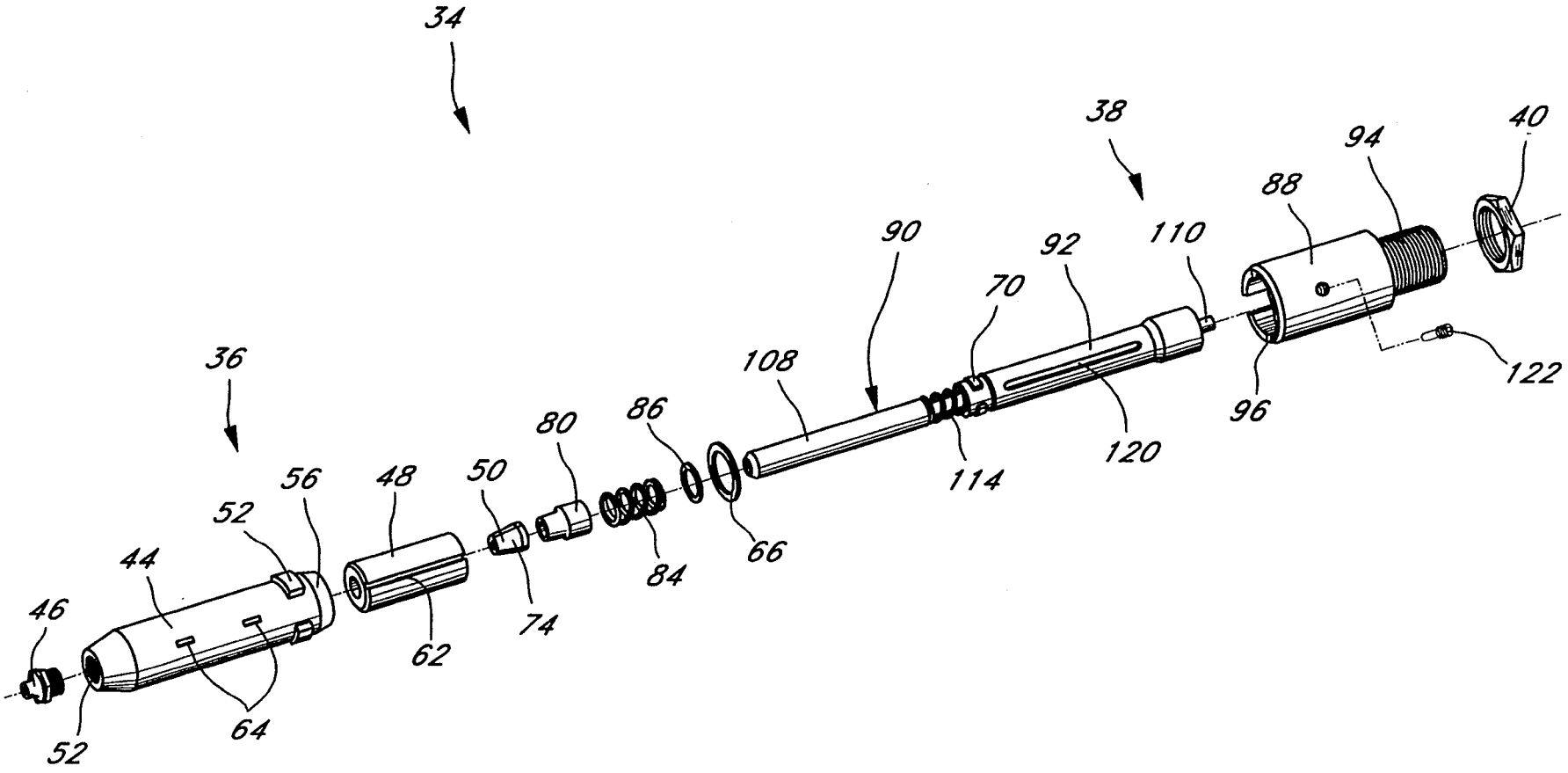
FIG. 6 is an exploded perspective view of the tool head depicted in FIG. 2, rotated such that the groove-/indent and slot/set screw features are illustrated.

The tubular collet 48 is located within the sleeve 44, immediately rearward of the nosepiece 46. The forward inner surface 60 of the collet 48 is tapered inwardly such that the smallest interior diameter of the collet 48 is at its extreme forward end. As best illustrated in FIGS. 3 and 6, the collet 48 has an axial groove 62 along its exterior surface. This groove 62 mates with rib indents 64 on the interior surface of the sleeve 44, thereby preventing relational rotation of the collet 48 and the sleeve 44 when the collet 48 is inserted into the sleeve 44. The collet 48 is prevented from sliding out of the sleeve 44 by a retaining ring 66.

As best illustrated in FIGS. 3, 4, 4*a*, and 4*b*, the rearwardmost interior surface of the collet 48 has three drawbar lug notches 68 to matingly receive three drawbar lugs 70. The notches 68 are equally spaced around the perimeter of the collet 48, i.e., 120° apart. As seen in FIG. 3, on the interior surface of the collet 48 and immediately forward of the notches 68 is channel 72, in which the drawbar lugs 70 are positioned once they have been translated through and cleared the notches 68.

A frustum-shaped set of jaws 50 is positioned within the collet 48 at its forward end. The exterior surface of each of the jaws 50 is tapered inwardly to form a jaws taper 74 such that the smallest exterior diameter of the jaws 50 is at its extreme forward end. The jaws taper 74 is of the identical slope as the collet taper 60 and therefore adapted such that the two opposing tapers fit flush against one another. This "self-centering" feature enables the jaws 50 to quickly and easily assume and retain axial alignment with the collet 48, regardless of their lateral position relative to one another. In addition, the forward end surface of the jaws 50 is tapered to be somewhat concave.

Figure 5:
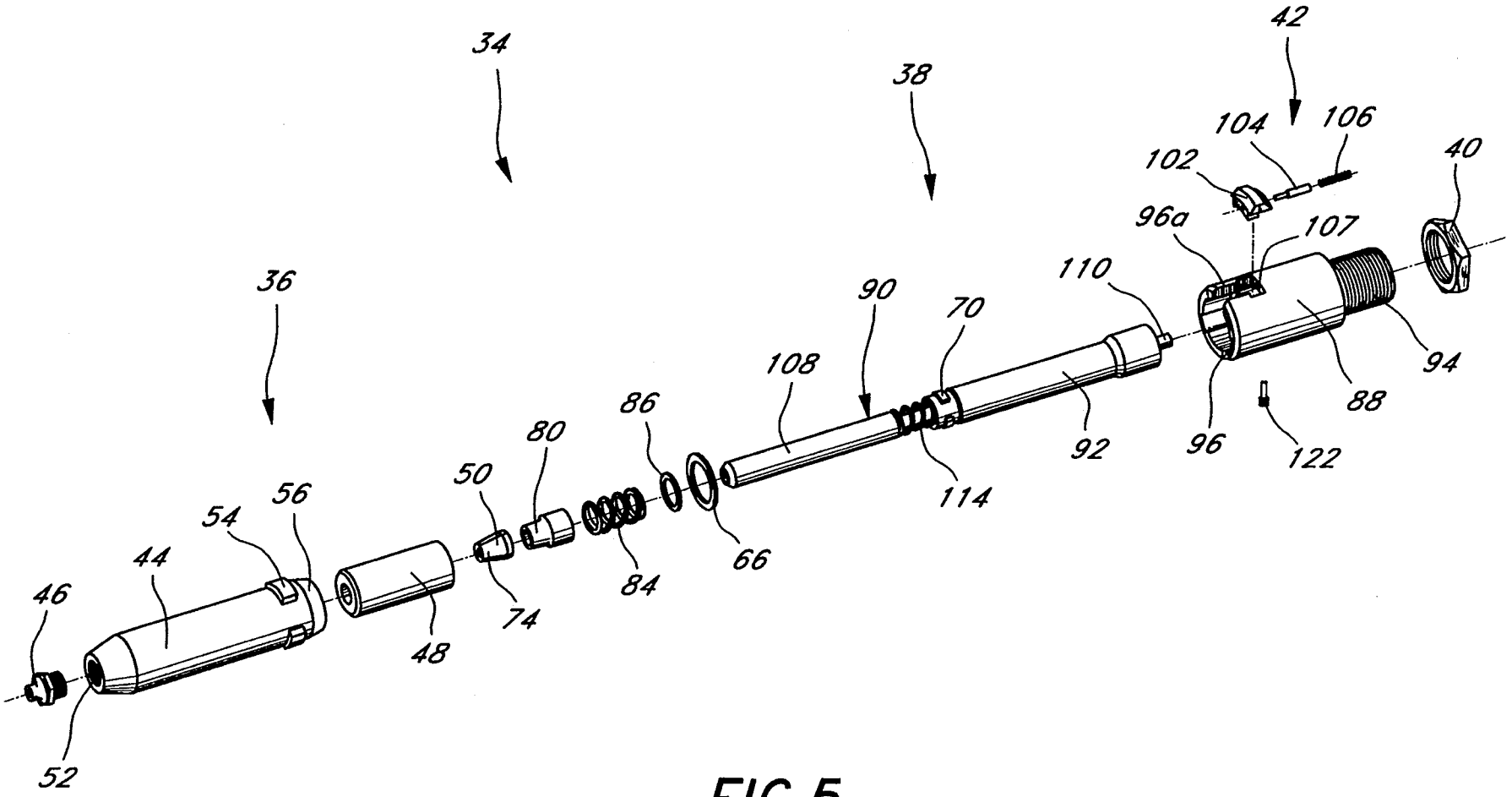
FIG. 5 is an exploded perspective view of the tool head depicted in FIG. 2, rotated such that the latching mechanism is illustrated.

As best illustrated in FIGS. 4*a*, 5 and 6, the set of jaws 50 is comprised of three independent yet identical jaws, with each jaw comprising one-third or 120° of the entire frustum. As seen in FIG. 3, the jaws 50 contain a central bore 76 that is slightly smaller than the nosepiece central bore 58. Gripping grooves 78 are machined into the inner surface of the jaws central bore 76 in order for the jaws 50 to securely grasp a rivet stem.

A jaw follower 80 is contained entirely within the collet 48 and rests immediately rearward of the jaws 50. The forward end of the jaw follower 80 abuts the rearward surface of the jaws 50. The jaw follower 80 has a jaw bore 82 running through its central axis. The rearward end of the jaw follower 80 is in contact with a jaw spring 84 located within the collet 48. The spring 84 is fixed within the collet 48 by a retaining ring 86. The spring 84 applies axial pressure to the jaw follower 80, which in turn applies axial pressure to the jaws 50. Consequently, the spring 84 forces the jaws 50 to their forwardmost position in which each individual jaw is in intimate lateral contact with the other two jaws. In this forwardmost position, the jaw central bore 76 is at its smallest diameter. The jaw follower central bore 82 is larger than the jaw central bore 76, to allow a broken rivet stem to pass rearwardly through the jaw follower central bore 82.

As best illustrated in FIGS. 3–6, the other principal component of the present invention is the adapter housing assembly 38 including housing 88, a latching mechanism 42, a jaw follower tube 90, and a drawbar 92. The tubular adapter housing 88 receives the sleeve assembly 36 at its forward end of the housing 88 and is fixed to the tool body 32 at its rearward end. As seen in FIG. 3, the interior diameter of the housing 88 at its forward end is only slightly larger than the exterior diameter of the sleeve 44 at its rearward end.

The rearward exterior surface 94 of the housing 88 has threads 94 for attachment to the tool body 32. To remove the adapter housing assembly 38, and thereby the entire tool head quick disconnect assembly 34, from the tool body 32, the mounting nut 40 is loosened to permit the assembly 38 to be unscrewed and removed from the tool body 32. To reinstall the assembly 38, the reverse procedure is performed.

The forward interior surface of the housing 88 has three sleeve lug grooves or notches 96 to matingly receive the three sleeve lugs 54. One of the grooves **96*a* extends radially through the housing wall and thus is effectively a slot open to the forward edge of the housing. The grooves or notches 96 are equally spaced around the perimeter of the housing 88, i.e., 120° apart. As seen in FIG. 3, on the interior surface of the housing 88 and immediately rearward of the notches 96 is an annular sleeve lug channel 98, in which the lugs 54 are positioned once they have been translated through and cleared the notches 96**.

An adapter housing annular taper 100 is located on the interior surface of the housing 88 just rearward of the sleeve lug channel 98. The taper 100 is of the identical slope as the sleeve taper 56 such that the two opposing tapers fit flush against one another. This "self-centering" feature enables the sleeve 44 to quickly and easily assume and retain axial alignment with the housing 88.

As best illustrated in FIGS. 3, 5, and 6, the latching mechanism 42 consists of a latch 102, a latch pin 104, and a latch spring 106. The latch body includes a radially inner portion which fits into an opening 107 in the housing that is open to the rear of groove **96*a* and opens radially inwardly to the channel 98. The opening also extends rearwardly beyond the channel and its circumferential dimension is greater than that of the groove 96*a*. The latch radial inner portion fits into the opening 107 but is circumferentially wider than the groove 96*a* so that forward movement of the latch is limited by the channel wall adjacent the groove 96*a*. The axial dimension of the latch is less than that of the opening 107 so that the latch can move rearwardly. The radially outer portion of the latch is circumferentially larger than that of the opening 107** so the latch radial inward movement is limited by the radially outer portion engaging the exterior of the housing.

The latch spring 106 is positioned within an axially extending socket 105 in the housing 88 that opens to the opening 107. The pin 109 is also in the socket in front of the spring 106 and extends into a hole in the latch. A shoulder on the pin engages the latch. The spring 106 applies axial pressure to the latch pin 104, which in turn applies axial pressure to the body 102. Consequently, in its resting state, the spring 106 forces the body 102 to its forwardmost position. In this resting position, the interior portion of the body 102 virtually entirely obstructs the upper portion of the sleeve lug channel 98, thereby preventing a sleeve lug 54 from resting within the upper portion of the channel 98 or passing through the uppermost sleeve lug notch **96*a*. When the latch 102 is translated to its maximum rearward position (either manually or otherwise), the spring 106 is compressed, and the channel 98 is entirely cleared of the obstructing latch, thereby permitting a lug 54 to fit entirely within the channel 98 or to pass through the uppermost notch 96*a***.

As seen in FIG. 3, the jaw follower tube 90 is composed of a forward jaw follower tube 108 and a rearward jaw follower tube 110. The forward end of the forward tube 108 abuts the jaw follower 80. A bore 112 through the tube 90 is approximately the same diameter as the jaw follower central bore 82, thereby allowing the tail of a rivet stem to pass rearwardly from the jaw follower central bore 82 through the tube 90.

The rearward tube 110 has a smaller outer diameter than the forward tube 108, but the diameter of the bore 112 running through the two components of the tube 90 is essentially identical. The forward portion of the rearward tube 110 is rigidly attached to the rearward portion of the forward tube 108. This rigid attachment can be accomplished by slightly enlarging the diameter of the bore 112 in the rearward portion of the forward tube 108 and then press fitting the forward portion of the rearward tube 110 into this enlarged portion of the bore 112.

A jaw follower tube spring 114 encircles the rearward tube 110 and abuts the rear of the forward tube 108. The rear of the spring 114 engages an inwardly extending annular flange **116*a* on a tubular drawbar piston 116. The spring 114 applies axial pressure to the forward tube 108, which in turn applies axial pressure to the jaw follower 80. Consequently, in its resting state, the spring 114 forces the tube 90 to its forwardmost position, in which the forward end of the forward tube 108 abuts the jaw follower 80**.

As seen in FIG. 3, the tubular drawbar 92 is a critical link between the tool head 34 and the tool body 32. The drawbar 92 is rigidly attached to the drawbar piston 116 via drawbar threads 118. As best illustrated in FIGS. 3, 4, **4*a*, and 4*b*, located on the exterior surface of the forward end of the drawbar 92 are the three drawbar lugs 70, equally spaced around the perimeter of the drawbar 92, i.e., 120° apart. These three lugs 70 are matingly received by the corresponding three drawbar lug notches 68 on the rearward interior surface of the collet 48. Once the lugs 70 have been translated through and have cleared the notches 68, the lugs 70 are in the drawbar lug channel 72**.

As best illustrated in FIGS. 3, **4*b* and 6, a single axial drawbar slot 120 is cut through the wall surface of the drawbar 92. The slot 120 runs from an area rearward of the lugs 70 and forward of the threads 118. The slot 120 to mates with a set screw 122 that runs through the side of the housing 88 and protrudes from its interior surface, thereby preventing relative rotation of the drawbar 92 and the housing 88 when the drawbar 92 is in the housing 88**.

Assembly of the Components

Referring now to FIGS. 4–6 in conjunction with FIG. 3, the novel manner in which the components of present invention are assembled and the unique way in which its components cooperate with one another to achieve the desired objectives can be described. The draw piston 116 protrudes from the forward end of the tool body 32 being slidably mounted therein and urged rearwardly by the follower spring 114. The jaw follower tube 90 runs through the center of the piston 16 and the tool body 32, extending considerably forward of the piston 116.

The assembly operation is composed of four steps: (1) assembling the adapter housing assembly 38; (2) mounting the adapter housing assembly 38 onto the tool body 32; (3) assembling the sleeve assembly 36; and (4) mounting the sleeve assembly 36 onto the adapter housing assembly 38. To assemble the adapter housing assembly 38, the drawbar 92 is inserted into the rear of the adapter housing 88. The drawbar 92 is positioned within the housing 88 such that the set screw 122 protruding from the inner surface of the housing 88 falls within the axial drawbar slot 120 cut into the surface of the drawbar 92. As illustrated in FIG. 4*b*, when the set screw 122 is positioned within the drawbar slot 120, the drawbar 92 and the housing 88 are rotationally aligned such that the drawbar lugs 70 and sleeve lug notches 96 are coincident along the same radii.

The next step is to mount the adapter housing assembly 38 onto the tool body 32. Ensuring that the housing 88 and the drawbar 92 remain aligned as describe above, the adapter housing assembly 38 is inserted over the protruding jaw follower tube 90 until the drawbar 92 abuts the piston 116 and the housing 88 abuts the tool body 32. Next, by rotating the adapter housing assembly 38 clockwise, the drawbar threads 118 on the drawbar 92 engage the mating threads on the piston 116 while simultaneously the adapter housing threads 94 on the housing 88 engage the mating threads on the tool body 32. The adapter housing assembly 38 is rotated clockwise until the drawbar 92 is firmly tightened against the piston 116. Finally, the mounting nut 40 is rotated clockwise until it is firmly tightened against the tool body 32, at which time a wrench is used to securely tighten the nut 40. Note that the nut 40 prevents the housing 88 from rotating during operation of the fastener installation tool 30, while the set screw 122 in the drawbar slot 120 prevents the drawbar 92 from rotating during operation of the tool 30.

The third step is to assemble the sleeve assembly 36. The nosepiece 58 is selected and screwed onto the forward end of the sleeve 44. Next, the collet 48 containing jaws, a jaw follower, and a spring is inserted jaws-first into the rearward end of the sleeve 44. Note that the jaws 50, the jaw follower 80, and the jaw follower spring 84 are all held permanently in place within the collet 48 by the jaw spring retaining ring 86.

The collet 48 is positioned within the sleeve 44 such that the rib indents 64 protruding from the inner surface of the sleeve 44 slide within the axial collet groove 62 cut into the surface of the collet 48. As illustrated in FIG. 4*a*, when the rib indents 64 are positioned within the collet groove 62, the collet 48 and the sleeve 44 are rotationally aligned and fixed such that the drawbar notches 68 and the sleeve lugs 54 are coincident along the same radii. Note that the rib indents 64 in the collet groove 62 prevent the collet 48 from rotating relative to the sleeve 44 during operation of the fastener installation tool 30.

The final step is to engage the sleeve assembly 36 with the adapter housing assembly 38. Ensuring that the sleeve 44 and the collet 48 remain aligned as described above, the sleeve assembly 36 is inserted over the protruding jaw follower tube 90 until the collet 48 abuts the drawbar 92 and the sleeve 44 abuts the housing 88. Next, the sleeve assembly 36 is rotated until the three sleeve lugs 54 on the rearward exterior surface of the sleeve 44 align with the three sleeve lug notches 96 on the forward interior surface of the housing 88. Note that when the sleeve lugs 54 are aligned with the sleeve lug notches 96, the drawbar lugs 70 on the forward exterior surface of the drawbar 92 must necessarily be aligned with the drawbar lug notches 68 on the rearward interior surface of the collet 48. This precise alignment occurs because the drawbar 92 is rotationally aligned with the housing 88 via the set screw 122 and the drawbar slot 120, while the collet 48 is rotationally aligned with the sleeve 44 via the rib indents 64 and the collet groove 62.

As best illustrated in FIGS. 4, 4*a* and 4*b*, there are three possible rotational positions in which the sleeve assembly 36 can engage the adapter housing assembly 38, each engagement position 120° from the other two. Once the sleeve lugs 54 have been aligned with the sleeve lug notches 96, and, concomitantly, the drawbar lugs 70 been aligned with the drawbar lug notches 68, the sleeve assembly 36 is pushed rearwardly to positively engage the adapter housing assembly 38. During this operation, the three sleeve lugs 54 pass through the sleeve lug notches 96 and come to rest in the sleeve lug channel 98. Again, concomitantly, the three drawbar lugs 70 pass through the drawbar lug notches 68 and come to rest in the drawbar lug channel 72. A critical event occurs as this engaging operation takes place: The uppermost sleeve lug 54 comes into contact with the latch 102 as that lug begins to enter into the sleeve lug channel 98. As described earlier, in the resting position of the body 102, the interior portion of the body 102 virtually entirely obstructs the upper portion of the sleeve lug channel 98, thereby preventing a sleeve lug 54 from resting within the upper portion of the channel 98 or passing through the uppermost sleeve lug notch 96. When the latch 102 is translated to its maximum rearward position (either manually or otherwise), the latch spring 106 is compressed and the channel 98 is entirely cleared of the obstruction, thereby permitting a sleeve lug 54 to rest entirely within the upper portion of the channel 98 or pass through the uppermost sleeve lug notch 96. Therefore, by applying rearward axial force to the sleeve assembly 36 (or alternatively either manually or automatically translating the body 102 to its maximum rearward position), all three sleeve lugs 54 can come to rest in the sleeve lug channel 98, and, concomitantly, all three drawbar lugs 70 can come to rest in the drawbar lug channel 72.

Another important feature of the invention is relevant here. When the sleeve assembly 36 has been translated rearwardly to its maximum rearward position such that the sleeve lugs 54 rest within the sleeve lug channel 98, the sleeve taper 56 and the adapter housing taper 100 come in intimate contact with one another. As described previously, the adapter housing taper 100 is of the identical slope as the sleeve taper 56, and therefore adapted such that the two opposing tapers fit flush against one another. This "self-centering" feature enables the sleeve assembly 36 to quickly and easily assume and retain axial alignment with the adapter housing assembly 38.

The final step required to engage the sleeve assembly 36 with the adapter housing assembly 38 is to axially rotate the sleeve assembly 36 60° in either a clockwise or a counterclockwise direction. Upon this rotation, the sleeve lugs 54 rotate within the sleeve lug channel 98 and come to rest directly in between the sleeve lug notches 96. At this rotational position, the sleeve assembly 36 cannot be disengaged from the adapter housing assembly 38 because the sleeve lugs 54 are within the sleeve lug channel 98 and do not have any notches 96 through which to pass. Again, concomitantly, upon this rotation, the drawbar lugs 70 rotate within the drawbar lug channel 72 and come to rest directly in between the drawbar lug notches 68. At this rotational position, the collet 48 cannot be disengaged from the drawbar 92 because the drawbar lugs 70 are within the drawbar lug channel 72 and do not have any notches through which to pass.

An important feature of the present invention is that upon rotating the sleeve assembly 36 60°, as described above, the uppermost sleeve lug 54 clears the uppermost portion of the sleeve lug channel 98. When this occurs, the latch spring 106 returns the latch 102 to its resting position, in which the interior portion of the body 102 virtually entirely obstructs the upper portion of the channel 98, thereby preventing a sleeve lug 54 from resting within the upper portion of the sleeve lug channel 98 or passing through the uppermost sleeve lug notch 96. In essence then, the latching mechanism 42 serves to lock the sleeve assembly 36 into rotational position. That is, the sleeve assembly 36 cannot be disengaged from the adapter housing assembly 38 until the latch body 102 is translated to its maximum rearward position. Moreover, the latching mechanism 42 prevents the sleeve assembly 36 from rotating relative to the adapter housing assembly 38 during operation of the fastener installation tool 30.

To disengage the sleeve assembly 36 from the adapter housing assembly 38, all that is required is to translate the latch 102 to its maximum rearward position, thereby clearing the sleeve lug channel 98 and then to axially rotate the sleeve assembly 36 60° in either a clockwise or a counterclockwise direction. Upon this rotation, the sleeve lugs 54 rotate within the sleeve lug channel 98 and come to rest directly in line with the sleeve lug notches 96. At this rotational position, the sleeve assembly 36 can be disengaged from the adapter housing assembly 38 by forwardly translating the sleeve lugs 54 through the sleeve lug notches 96. Indeed, the latching mechanism 42 assists in ejecting the sleeve assembly 36 from the adapter housing assembly 38. Specifically, when the uppermost sleeve lug 54 is positioned within the uppermost portion of the sleeve lug channel 98, the latch 102 is in its maximum rearward position. Consequently, the latch spring 106 is depressed and applies forward axial pressure to the uppermost sleeve lug 54 via the latch pin 104 and the latch 102, thereby forcing the lug 54 out of the channel 98 and through the notch 96*a*.

Operation of the Tool

Referring again to FIG. 3, the operation of the novel fastener installation tool 30 can now be readily described. When a rivet (not illustrated) is to be installed using the novel fastener installation tool 30, the stem of the rivet is inserted into the nosepiece 46 of the sleeve assembly 36. Because the jaws 50 are initially at their resting state, the jaws central bore 76 is at its smallest diameter, which is slightly smaller than the nosepiece central bore 58. As the rivet stem pushes against the forward tapered surface of the jaws 50, they are pushed rearwardly, and therefore forced open slightly until the rivet stem is able to pass through the jaws 50. The rivet stem passes through the jaws 50 and stops when the rivet head rests firmly against the forward end surface of the nosepiece 46. Because the jaw follower 80 has also been pushed slightly rearwardly, the spring 84 has been compressed somewhat. As a result, the jaw spring 84 applies even greater axial pressure to the jaw follower 80, which in turn applies even greater axial pressure to the jaws 50. Consequently, the jaws 50 firmly grasp the rivet stem. Moreover, the gripping grooves 78 on the interior surfaces of the jaws 50 grasp corresponding grooves on the stem of the rivet to ensure a firm grasp of the rivet stem.

Next, pressurized fluid is applied to the draw piston 116 within the tool body 32 and pulls the piston 116 rearwardly. As described earlier, the drawbar 92 is fixed to the piston 116 via drawbar threads 118. In addition, the collet 48 is engaged with the drawbar 92 because the drawbar lugs 70 are locked into their operational position within the drawbar lug channel 72 in the collet 48. Consequently, as a result of the piston 116 being pulled rearwardly, the drawbar 92 and the collet 48 are also pulled rearwardly.

The rearward movement of the collet 48 forces the jaws 50, the jaw follower 80, and the jaw follower tube 90 to all move rearwardly in conjunction with the collet 48. As the jaws 50 move rearwardly, they grip the rivet stem more and more tightly.

Rearward movement of the jaw follower tube 90 necessarily compresses the jaw follower tube spring 114. As the spring 114 is compressed, it applies more and more forward axial pressure on the jaw follower tube 90, which in turn applies more and more forward axial pressure on the jaw follower 80, which in turn applies more and more forward axial pressure on the jaws 50. As a result, the opposing jaws taper 74 and collet taper 60 force the jaws 50 to constrict even more tightly around the rivet stem.

After the piston 116 has been engaged and begins to rearwardly translate the drawbar 92, the collet 48, and the jaws 50 which are firmly grasping the rivet stem, the rivet is set in the usual fashion. Upon increased load, the tool of the rivet stem eventually breaks off from the remainder of the stem in the rivet sleeve. Ideally, the rivet stem breaks cleanly at a specially formed breakneck groove located at the base of the rivet head. In this event, the broken rivet stem is free to be sucked through both the jaws central bore 76 and the jaw follower central bore 112. The free rivet stem can then be translated rearwardly through the jaw follower tube central bore 112 and expelled through the rear of the jaw follower tube 90 by the application of a vacuum to the tube 90.

As has been discussed previously, however, during the operation of the fastener installation tool 30, a rivet may become undesirably lodged within the sleeve assembly 36, thereby obstructing it. More specifically, the rivet stem may not break cleanly at the breakneck groove, it may wedge between the three independent jaws 50, or some other mishap may occur. If such an undesirable eventuality occurs, the rivet stem may become lodged within the sleeve assembly 36, thereby preventing further operation of the fastener installation tool 30.

The present invention greatly facilitates the correction of this problem. As described previously, the obstructed sleeve assembly 36 can be quickly and easily removed from the adapter housing assembly 38 and an obstruction-free sleeve assembly 36 can be quickly and easily reinstalled on the adapter housing assembly 38. The significant changeover time-saving achieved by using the novel tool head quick disconnect assembly 34 greatly reduces the down time of the fastener installation tool 30 due to rivet jams. The jammed head assembly can be taken as a unit to a convenient repair area to be disassembled and unjammed. Note that the jammed collet unit is retained in the sleeve to permit easy handling. In the end, the production line is interrupted for only a short time because of tool head changeovers, resulting in significantly increased line productivity and therefore substantial cost savings.

The foregoing description should be taken as illustrative and not as limiting. Additional advantages and modifications will be readily apparent to those skilled in the art. The invention in its broader aspects is, therefore, not limited to the specific details, preferred embodiment, or illustrative examples shown and described. Accordingly, departures may be made from such details without departing from the spirit or scope of the general inventive concept as defined by the appended claims and their equivalents.

As one example of this, it should be noted that the feature of having the head assembly replaceable as a unit with the jaws and jaw follower captured in the collet, and the collet in turn captured in the sleeve is useful for reducing production line down time, without having the quick disconnect lugs and latching. That is, the invention provides a significant improvement even if the separate head assembly is joined by other means, since the assembly can be replaced as a unit and unjammed elsewhere.

What is claimed is:

1. A fastener installation tool comprising:

a tool body including piston therein for providing pulling force on a fastener stem;

an adapter assembly attached to a forward end of the tool body and including a housing and a drawbar concentrically positioned within the housing and connected to said piston;

a tool head assembly including a sleeve and a collet concentrically positioned within the sleeve; and connectors on said adaptor assembly and said tool head assembly joining said adaptor housing and said sleeve and simultaneously joining said drawbar to said collet;

said housing and said drawbar being interconnected to prevent relative rotation with respect to each other and to permit relative reciprocation with respect to each other before said adaptor assembly is joined to said tool head assembly, and said sleeve and said collet being interconnected to prevent relative rotation with respect to each other and to permit relative reciprocation with respect to each other before said tool head assembly is joined to said adaptor assembly so that said housing, sleeve, drawbar and collet are properly angularly oriented when said housing and said sleeve are connected by said connectors and said drawbar and said collet are properly oriented when they are simultaneously connected by said connectors.

2. The tool of claim 1, wherein said sleeve and said collet are connected in a manner that prevents relative rotation between the collet and the sleeve, but permits axial reciprocation of the collet in the sleeve.

3. The tool of claim 1, wherein said sleeve and said collet include an interengaging rib and slot arrangement that prevents relative rotation between the collet and sleeve, but permits axial reciprocation of the collet in the sleeve.

4. The tool of claim 3, wherein said arrangement includes an axially extending groove formed in the exterior of said collet and an inwardly extending rib formed on the interior of said sleeve to fit within said collet groove.

5. The tool of claim 1, including a plurality of fastener stem-gripping jaws positioned in a forward end of said collet, a jaw follower positioned in said collet rearwardly of said jaws, a retaining ring positioned in an interior portion of said collet spaced rearwardly from said follower, and a spring extending between said retaining ring and a rear of said collet urging said jaw follower and said jaws forwardly while the retaining ring captures the spring, the follower and the jaws within said collet so that the collet may be removed from the rear of said sleeve as a separate unit.

6. The tool of claim 5, including a retaining ring extending inwardly in the rear of said sleeve for capturing said collet within said sleeve so as to permit said sleeve together with said collet and its components to be removed as a unit from said adaptor assembly.

7. The tool of claim 1, wherein a rear of said sleeve and a forward end of said housing have mating tapered surfaces that facilitate the engagement of the component in a self-centering manner.

8. A fastener installation tool comprising:

a tool body including a piston therein for providing pulling force on a fastener stem;

an adaptor assembly attached to a forward end of the tool body including a housing and a drawbar concentrically positioned within the housing and connected to said piston;

a tool head assembly including a sleeve and a collet. concentrically positioned within the sleeve; and a set of interengaging lugs and notches formed on said housing and said sleeve to join said housing and said sleeve, and a set of interengaging lugs and notches on said drawbar and said collet to simultaneously join said drawbar to said collet.

9. The tool of claim 8, wherein said lugs and notches are circumferentially spaced so that the lugs may be axially aligned with their respective notches to permit a rear of said sleeve to be concentrically positioned with respect to a forward end of said adaptor housing and to permit a rear of said collet to be concentrically positioned with respect to a forward end of said drawbar.

10. The tool of claim 3, including an annular channel adjacent each set of grooves to receive the respective set of lugs so as to permit the tool head assembly to be rotated with respect to the adaptor assembly so that the lugs are not aligned with the respective set of notches so that each set of lugs are captured in a respective channel.

11. The tool of claim 10, including a latching mechanism on said housing locking said lugs in said channels, said latching mechanism being manually releasable to allow said tool head assembly to be rotated and moved axially to disengage said interengaging lugs and notches.

12. The tool of claim 8, wherein said lugs and notches on said sleeve and said housing include the plurality of circumferentially spaced lugs on the exterior of said sleeve and a plurality of circumferentially spaced notches on the interior forward end of said housing.

13. The tool of claim 12, including an annular channel positioned in a forward end of said housing immediately rearwardly of said housing notches, with said channel being sized to receive said sleeve lugs so that said sleeve lugs may be captured within said channel when the sleeve is rotated so that the sleeve lugs are no longer aligned with the adaptor housing notches.

14. The tool of claim 13, including a spring loaded latch aligned with one of said adaptor housing notches to block the insertion of said sleeve lugs into said channel, said latch being manually retracted to a position to enable said sleeve lugs to enter said channel and rotate out of axial alignment with said housing notches, and said latch being releasable into a position once more blocking said one notch and thereby locking said sleeve lugs in said channel.

15. The tool of claim 8, wherein the lugs and notches joining the drawbar to said collet include a plurality of circumferentially spaced lugs on a forward end of said drawbar and a plurality of circumferentially spaced notches on a rear of said collet, and said collet includes an annular channel positioned forwardly of said collet notches whereby said drawbar lugs may be inserted between said collet notches and into said channel, and said collet rotated so that the drawbar lugs are locked in said collet channel.

16. A fastener installation tool comprising:

a tool body including a piston therein for providing pulling force on a fastener stem;

an adapter assembly attached to a forward end of the tool body and including a housing and a drawbar concentrically positioned within the housing and connected to said piston;

a tool head assembly including a sleeve and a collet concentrically positioned within the sleeve;

connectors on said adaptor assembly and said tool head assembly to join said adaptor housing and said sleeve and simultaneously to join said drawbar to said collet;

said housing and the drawbar being connected in a manner to prevent relative rotation of the drawbar with respect to the housing while permitting axial reciprocation of the drawbar with respect to the housing; and the housing and the drawbar being connected by a set screw extending through a wall of said housing into an axially extending slot in an exterior of said drawbar.

17. A fastener installation tool comprising:

a tubular housing having threads on a rear end for connection to a tool body and having a quick disconnect connection on a forward end for connection to a fastener tool head assembly;

a tubular drawbar concentrically positioned within said housing having a threaded end for connection to a piston in said tool body for applying pulling force to a fastener stem, said drawbar having a forward end with a quick disconnect connector for attachment to a rear of a collet in said tool head assembly;

said housing and said drawbar having interengaging elements for maintaining said drawbar in a desired rotational position with respect to said housing for permitting axial reciprocation of said drawbar within said housing;

a plurality of circumferentially spaced axially extending notches in said housing forward end, with one of said notches extending completely radially through the housing, an annular channel formed in an interior of said housing immediately rearwardly of said notches whereby the notches are in communication with said channel, an opening through a wall of said housing immediately rearwardly of said one notch, said opening being in communication with said channel and said one notch, said opening having a circumferential dimension slightly larger than a circumferential dimension of said one notch whereby a shoulder is formed on each side of said opening adjacent said notch, said opening extending axially rearwardly beyond said channel;

a latch including an inner portion positioned within said opening with the inner portion being larger circumferentially than the rear of said one notch so that said inner portion engages said shoulders, an axial dimension of said inner portion being less than that of said axial dimension of said opening so that the inner portion is axially moveable within said opening, said latch further having a radially outer portion which is larger circumferentially than said opening so that radially inward movement of said latch is limited by an outer portion of the latch engaging said housing; and a socket in a wall of said housing rearwardly of said opening, a coil spring positioned within said socket, a latch pin having a rear end positioned in said socket and having a forward end positioned in said latch, with said spring and said pin urging said latch into a forward position against said shoulders, and with said pin holding said latch in said opening, said latch being manually moveable against said spring so as to move an inner portion of the latch to a rear of said channel so as to allow lugs of a mating component to be positioned rearwardly into said notches and then rotated into said channel.

18. A tool for installing fasteners of the type having a sleeve and a stem which is pulled to enlarge the end of the sleeve after the fastener is installed in a workpiece, said tool including a tool head assembly comprising:

a sleeve;

a nose piece attached to a forward end of the sleeve for receiving a fastener stem;

a tubular collet positioned within the forward end of the sleeve rearwardly of said nose piece;

a plurality of jaws positioned in a forward end of the collet with forward ends of the jaws adjacent said nose piece;

a jaw follower positioned in said collet rearwardly of said jaws;

a coil spring in said collet having a forward end engaging a rear of said jaw follower;

a retaining ring within said collet capturing the spring in compression within said collet so that the spring urges the jaw follower and the jaws into the forward end of the collet, said collet together with said jaws, jaw follower and spring being removable from said sleeve as a unit;

a retainer spring on the interior of said sleeve capturing said collet within said sleeve so that the sleeve and the collet may be handled as a separate unit;

a rear of said sleeve being adapted to be connected to a forward end of a housing of said tool;

a rear of said collet being adapted to be connected to a forward end of a drawbar in said housing, simultaneously as the rear of said sleeve is connected to said tool housing; and said collet and said sleeve including interengaging elements that cause the collet to be rotationally fixed with respect to said sleeve while permitting said collet to be reciprocated within said sleeve;

the rear of said sleeve and the rear of said collet being formed with lugs and notches enabling the sleeve and the collet to be quickly connected an disconnected to mating lugs and notches on said housing and on said drawbar.

19. A method for connecting a fastener installation tool head to a fastener installation body, said tool head including a collet mounted for reciprocation within a sleeve, said installation body including an adaptor housing and a drawbar slidably mounted in the housing, said method comprising:

interengaging lugs and notches on said sleeve and housing to axially align the sleeve and housing in concentric position;

interengaging lugs and notches on said collet and said drawbar to axially align the lugs and notches on said collet and drawbar and position the collet and drawbar in concentric relation; and rotating said sleeve and collet with respect to said housing and drawbar to lock the lugs on one of said sleeve and housing into an annular channel on the other of said sleeve and housing, and simultaneously locking the lugs on one of said collet and drawbar into an annular channel into the other of said collet and drawbar.

20. The method of claim 19, including connecting said collet to said sleeve so that the collet can be axially reciprocated in said sleeve but is prevented from rotating with respect to said sleeve; and connecting said drawbar and said housing so that the drawbar may be reciprocated in the housing but is prevented from rotating with respect to said housing.

21. The method of claim 19, including inserting a rear of said sleeve into a forward end of said housing and inserting a forward end of said drawbar into a rear of said collet; and rotating the sleeve and the collet to capture lugs on the forward end of said drawbar in a channel in the rear of said collet and to capture lugs on the rear of said sleeve into a channel in the forward end of said housing.

22. A method for connecting a fastener installation tool head to a fastener installation tool body comprising:

connecting a rear of a tool head sleeve to a forward end of an adaptor housing connected to said tool body;

connecting a rear of a collet within said sleeve to a forward end of a drawbar within said housing simultaneously with the connection of said sleeve to said housing;

disengaging said tool head from said tool body by manually moving a latch on said housing rearwardly so that the latch does not block rotation of the sleeve with respect to said housing;

rotating the sleeve with respect to the housing so that the lugs on said sleeve are aligned with notches in said housing; and axially withdrawing said sleeve from said housing.

23. A method of connecting a fastener installation tool head to a fastener installation body comprising:

threadably connecting an adaptor housing to a tool body containing a piston;

interconnecting a drawbar in said housing so that the drawbar may be reciprocated in the housing by said piston but is prevented from rotating with respect to said housing;

inserting partially into a sleeve of said tool head a collet carrying a plurality of jaws for gripping a fastener stem;

rotating said collet to axially align interengaging structure on an exterior surface of said collet and an interior surface of said sleeve;

axially inserting said collet further into said sleeve so that the interengaging structure on said sleeve and said collet prevent the collet from rotating with respect to the sleeve while permitting axial movement of the collet within the sleeve;

telescopically connecting said sleeve to said housing while simultaneously connecting said drawbar to said collet so as to circumferentially align locking structure on said housing and said sleeve and simultaneously circumferentially align locking structure on said drawbar and said collet; and rotating said sleeve and collet approximately 60° to a locking position wherein said tool head is rotationally and axially locked with respect to said housing and said drawbar.

24. The method of claim 23, including depressing a latch on said housing to unlock the connection between said tool head and said adaptor housing to permit the tool head to be rotated approximately 60° and then withdrawn axially from said housing.

* * * * *